US006606752B2

(12) United States Patent
Marbach

(10) Patent No.: US 6,606,752 B2
(45) Date of Patent: Aug. 19, 2003

(54) COVERABLE ABOVE-GROUND POOL

(75) Inventor: Gérard Marbach, Cernay (FR)

(73) Assignee: Sevylor International, Issy les Moulimeaux (FR)

( * ) Notice: Subject to any disclaimer, the term of this patent is extended or adjusted under 35 U.S.C. 154(b) by 0 days.

(21) Appl. No.: 10/209,119

(22) Filed: Aug. 1, 2002

(65) Prior Publication Data

US 2003/0051290 A1 Mar. 20, 2003

(30) Foreign Application Priority Data

Aug. 2, 2001 (FR) ..... 01 10393

(51) Int. Cl.[7] ..... E04H 4/00
(52) U.S. Cl. ..... 4/500; 4/498
(58) Field of Search ..... 4/498, 500, 502, 4/503

(56) References Cited

U.S. PATENT DOCUMENTS

| | | | | |
|---|---|---|---|---|
| 3,523,308 A | | 8/1970 | Bradley | |
| 3,707,007 A | * | 12/1972 | Trostler | 4/500 |
| 5,068,928 A | | 12/1991 | Powell | |
| 5,107,552 A | * | 4/1992 | Lavalliere et al. | 4/502 |
| 5,887,296 A | | 3/1999 | Handwerker | |
| 5,924,144 A | | 7/1999 | Peterson | |
| 6,241,207 B1 | * | 6/2001 | Powell | 248/304 |
| 6,286,157 B1 | * | 9/2001 | Baumann | 4/503 |
| 6,523,189 B1 | * | 2/2003 | Weatherbee | 4/498 |

FOREIGN PATENT DOCUMENTS

DE 29912128 10/1999

OTHER PUBLICATIONS

Copy of Preliminary Search Report for French Patent Application No. 0110393.

* cited by examiner

*Primary Examiner*—Charles E. Phillips
(74) *Attorney, Agent, or Firm*—Dean W. Russell; Kilpatrick Stockton LLP

(57) ABSTRACT

An above-ground pool (1) having a protruding edge (3) and which can be covered with a cover (6): the folded cover, possibly enclosed in a bag (7) is anchored to a first location ($P_1$); next, it is unfolded and drawn over the pool successively on either side thereof and it is successively anchored at two points ($P_2$, $P_3$) such that a line joining these two points is located at arm's length from a fourth point ($P_4$) on the opposite side from the first point ($P_1$); finally, it is drawn from the point ($P_4$) where the lacing means (12) passing peripherally under the edge (3) are tied.

11 Claims, 3 Drawing Sheets

COVERABLE ABOVE-GROUND POOL

This application claims priority to French Patent Application No. 01 10393 filed on Aug. 2, 2001, the entire contents of which are incorporated by reference herein.

FIELD OF THE INVENTION

The present invention relates to the field of aboveground pools and, more specifically, it relates to improvements made to above-ground pools which can be covered using a removable cover, the pool and the cover being provided with mutual fastening means distributed over their respective perimeters.

DESCRIPTION OF THE PRIOR ART

In the case of pools of generally round shape—a shape which is that of many models of above-ground pools, whatever the type—the absence of an angular region suitable for making it easy to start putting a cover in place requires the presence of two people, located one on either side of the pool, in order to unroll and fasten the cover.

Moreover, above-ground pools of the type called "self-supporting" are provided with an air-inflated chamber which forms the upper edge of the container and which, because of its buoyancy, tensions the flexible sidewall of the container filled with water. Now, apart from the fact that this type of pool is round and has the aforementioned drawback, the presence of the very rounded edge formed by the buoyancy chamber contributes to making the cover slide when starting to fit it onto the pool: for this reason too, the presence of two people proves to be useful, or even essential in order that the cover can be fitted and fastened over the pool.

SUMMARY OF THE INVENTION

The aim of the invention is to overcome the drawbacks which have just been mentioned and to provide an improved arrangement for the pool and for the cover which allows the cover to be placed and fastened over the pool by a single person and with a minimum number of manipulations, whatever the shape—even round—of the pool and even where the pool has a rounded upper edge which is not very useful at least for starting to fit the cover, said improved arrangement moreover having to be structurally as simple as possible and not to involve too great an additional cost.

To these ends, it is proposed a coverable above-ground pool as mentioned in the preamble, wherein, according to the invention:

- the pool has an upper edge protruding radially outward from the immediately underlying sidewall,
- first fastening means are provided on the cover folded in an arrangement for storage and in a first location on the perimeter of the pool, under said peripheral edge projecting therefrom, to allow the initial attachment of the cover to the pool,
- second and third fastening means are provided in a second and a third location respectively, on the perimeter of the cover and on the perimeter of the pool, under the peripheral edge projecting there from, for the intermediate attachment of the cover, these second and third locations being located on either side of the mid-plane of the pool passing through said first location and being located such that a line joining them is located at not more than arm's length from a fourth location of the pool opposite said first location,
- and lacing means are secured to the peripheral edge of the cover with tensioning means located at a fourth location on the perimeter of the cover located approximately on the opposite side from said first fastening location and corresponding with said fourth location of the pool, said tensioning means being suitable for allowing the lacing means engaged under the peripheral edge projecting from the pool to be tightened.

The arrangement according to the invention proves to be particularly beneficial because of the simplification in handling that it affords. This is because, once the folded cover has been attached to the pool at said first location thereof, this first attachment acts as an anchoring point for the cover over the pool: the user then has both hands free to unfold the cover and to start to open it out while following one of the sides of the pool until reaching the second fastening location where he attaches the pulled side of the cover. The user then passes to the other side of the pool where he grabs the other side of the cover which he can pull up to the third fastening location where he attaches the cover. It is then enough for him to pass to the fourth location, located on the side opposite the aforementioned first location, from which he can grab the remaining free edge of the cover and pull it toward him, in order finally to finish fastening it by using the means for tightening the lacing means (in practice, by gripping and tying the ends of the lacing cord) engaged under the projecting edge of the pool.

Thus, the cover may, according to the desired aim of the invention, be quickly put in place by a single person, quickly and without particular difficulty, with a smaller number of maneuvers (in principal four in the context of the procedure mentioned above).

Advantageously, the second and third fastening locations are located approximately symmetrically on either side of a line joining the first and fourth locations on the perimeter of the pool and of the cover.

In a preferred embodiment, the cover is secured to a bag suitable for containing it folded in a storage arrangement and the first fastening means are secured to said bag. Advantageously, the bag has at least one perforated region, located toward its bottom, for the water to flow out. Also in a desirable manner, the bag comprises closure means suitable for keeping it closed while the cover is unfolded over the pool, so as to prevent water (overflow from the pool, rain) falling into the empty gaping bag.

It is also desirable to make sure that the fastening means are simple and without movable pieces, on the one hand, in order to obtain as low a manufacturing cost as possible and, on the other hand, in order to simplify the putting on and taking off of the cover as much as possible. To this end, provision can be made for the fastening means to comprise, on the one hand, T-shaped fingers fastened to the pool or to the cover (or to the bag, respectively) and, on the other hand, eyelets suitable for accommodating said T-shaped fingers and provided on the cover (or on the bag, respectively) or on the pool. In the context of the arrangement of the preferred embodiment indicated above, the first fastening means may comprise at least one T-shaped finger provided on the storage bag at the first location of the folded cover and at least one corresponding eyelet provided at the first location on the perimeter of the pool and the second and third fastening means may comprise eyelets provided at the second and third locations of the respective cover and T-shaped fingers provided at the second and third locations of the perimeter of the pool.

In a beneficial particular application, the arrangements of the invention apply to self-supporting aboveground pools: in this case, the pool is defined peripherally by at least one inflatable flexible chamber and the means for fastening and the means for lacing the unfolded cover are located under this chamber.

Still with the aim of simplifying the task of a user working alone in taking off the cover, provision is made for the cover to have a region, which is permeable to liquids, in the form of a strip lying approximately in a direction joining the first and fourth fastening locations and extending over most of the distance separating said locations, for the purposes of allowing water deposited on the top of the cover used over the pool to pass through. In this case, it is possible to envisage in an advantageous manner that the cover further comprises two regions, which are permeable to liquids, which are located on either side of said region in the form of an elongated strip and over a transversal to the latter approximately in its middle and toward the periphery of the cover, in order to make it easier to remove water retained on the cover.

As already envisaged above, the arrangements of the invention are most particularly applicable to pools which have a periphery of continually concave curved general shape, in particular approximately round.

BRIEF DESCRIPTION OF THE DRAWINGS

The invention will be better understood on reading the following detailed description of certain embodiments given by way of non-limiting example. In this description, reference may be made to the appended drawings in which.

DETAILED DESCRIPTION OF THE INVENTION

Figure 1:
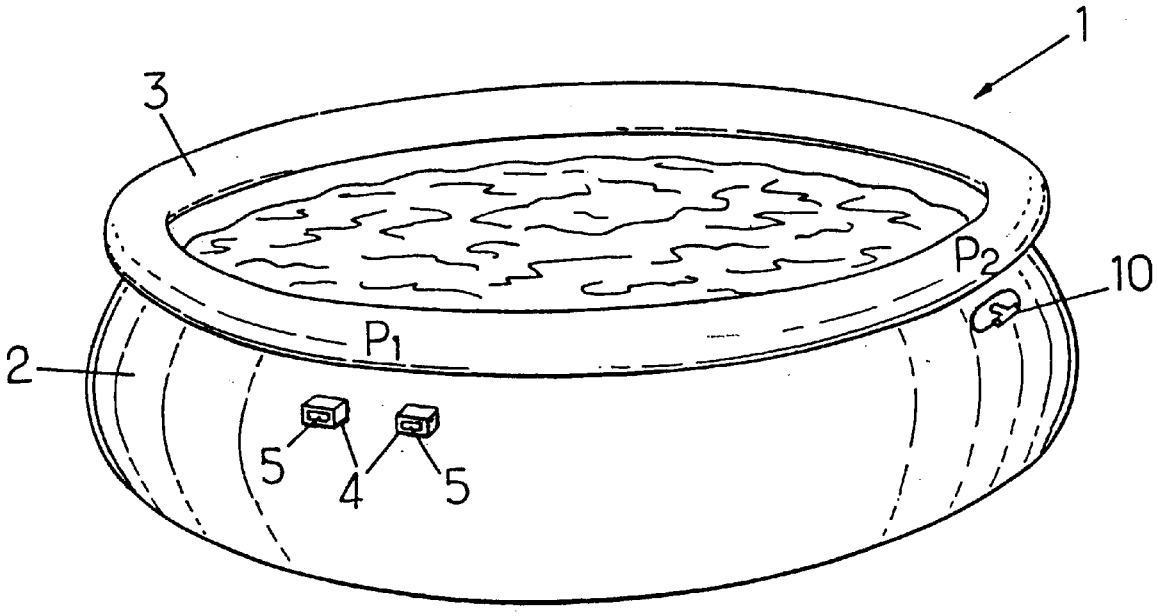
FIG. 1 is a perspective view of a pool equipped according to the invention so that it can be covered with a cover.

FIG. 1 illustrates, by way of example, a round above-ground pool 1, of the self-supporting type, in which the flexible wall 2 is supported by an air-inflated peripheral chamber 3 which extends along the upper peripheral edge. Although the arrangements of the invention may be applied to many types of pool of various shapes and/or structures, it is in the case of a self-supporting pool such as the one illustrated that the invention seems to be due to find a preferred application because of its overall round shape and the overall toroidal shape of its upper edge which complicates putting a cover in place.

As is visible in FIG. 1, fastening means for a cover are placed on the outer face of the flexible wall 2 and immediately below the chamber 3. These fastening means are discontinuous and distributed over the perimeter of the pool. All these means could be identical in order to cooperate with complimentary means, themselves mutually identical, provided on the cover. However, in order to facilitate putting on and taking off a cover by a single person, provision is made as follows.

At a first location $P_1$ of the pool (in principle located anywhere because of the round shape of the pool), there are first fastening means preferably of female type, that is to say in the form of an eyelet or the like. These first fastening means are intended for the first attachment of the cover and, in order to facilitate the work of the user operating alone, it is desirable that these first fastening means are in rigid form. It is for this reason that they may consist of a connecting block, or preferably, as illustrated, by two connecting blocks 4 fastened side by side on the flexible wall of the pool. These connecting blocks are hollow and they comprise, on their front face, an elongated opening 5.

Figure 2:
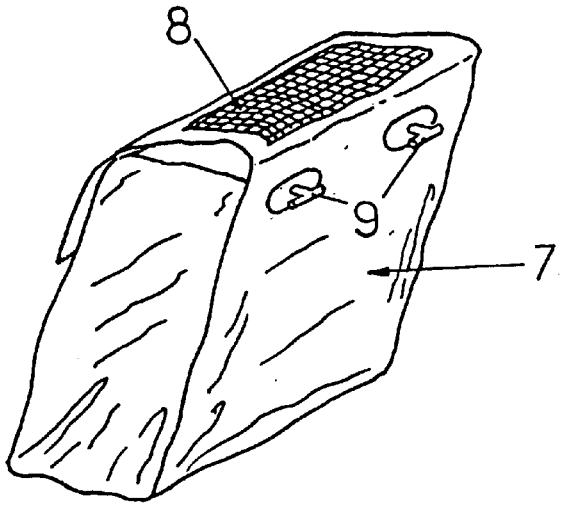
FIG. 2 is a perspective view of a preferred embodiment of a pool cover arranged according to the invention and shown in the folded state in a storage bag.

For its part, the cover 6 illustrated in FIG. 2, which is intended to be fastened to the pool 1 in order to cover and protect the latter, is, in the folded state for the storage arrangement, in the form of an overall parallelepipedal package held by any suitable means (webbing, strap). In a preferred manner, the folded cover is contained in a bag 7 which is secured to the cover. To prevent damage to the folded cover in the presence of water and moisture, it is desirable that the bag 7 has at least one perforated region, toward its bottom, for the water to flow out and, advantageously, an opening 8, for example covered with mesh, in its upper part in order to ventilate its content.

On its back, the package formed by the folded cover or, in the example illustrated, the bag 7 comprises first first fastening means that are the complement of the aforementioned fastening means of the pool. As is visible in FIG. 2, the first fastening means provided on the bag 7 are in the form of one, or preferably two, T-shaped fingers 9 separated from each other. The transverse bar of the T of the two fingers 9 can be fitted into the connecting blocks 4, the transverse bar of the T having, for this purpose, a length slightly greater than the length of the openings 5 so that once engaged in the connecting block 4 through the opening 5, it cannot be released without suitable manipulation.

Figure 3:
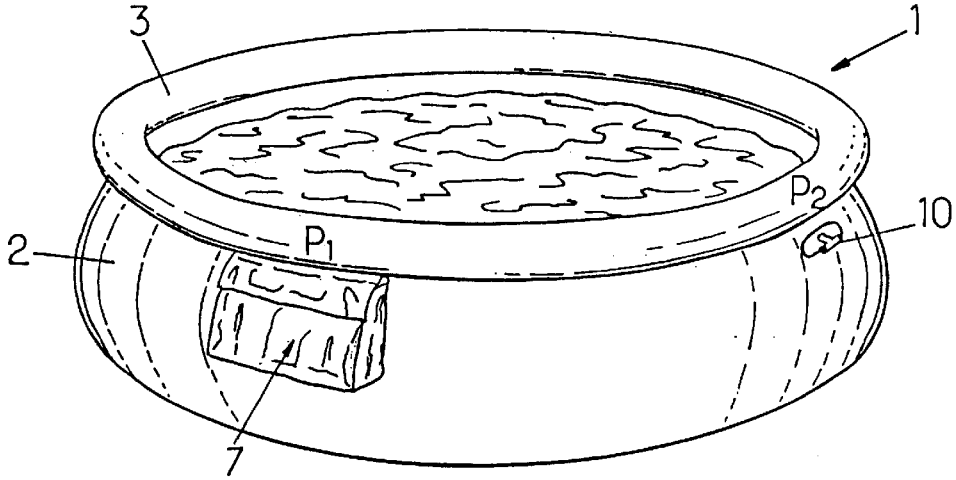
FIGS. 3 to 5 are perspective views respectively illustrating three steps of putting the cover of FIG. 2 in place over the pool of FIG. 1.

To put the cover in place, the user starts by attaching the folded cover, or the bag 7 in the preferred embodiment illustrated in FIG. 3, by fitting the fingers 9 of the bag in the connecting blocks 4 of the pool 1.

Figure 4:
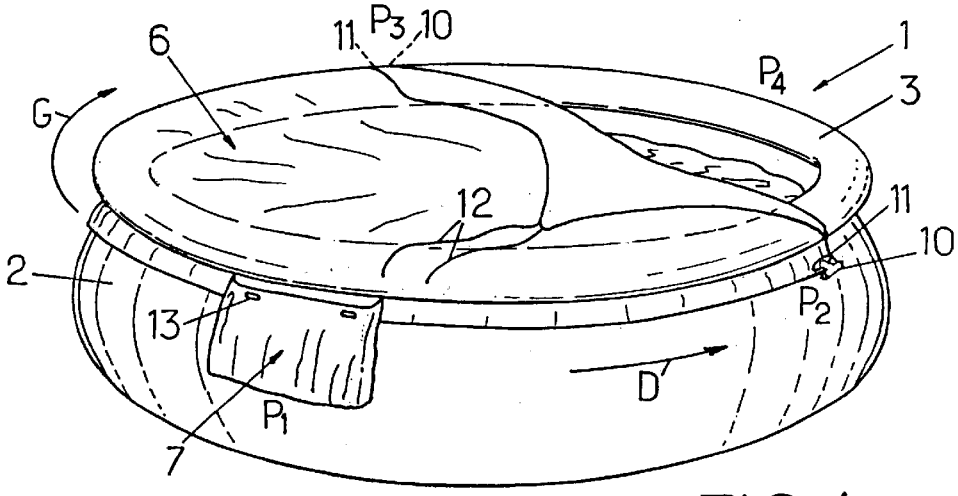

The user then opens the bag 7, unfolds the cover 6 and starts to open it out above the pool by first of all moving along one side of the pool (for example the right-hand side—arrow D) as illustrated in FIG. 4. On this side, and at some distance from the first attachment means 4, the pool 1 is provided, at a second location $P_2$, with second fastening means which, for example, consist of a T-shaped finger 10. For its part, the cover 6 is provided with corresponding second fastening means which, in the example in question, consist of an eyelet 11 which is suitable to fit onto said T-shaped finger 10.

Once the cover 6 is therefore fastened on a first side, the user passes to the other side of the pool and pulls the cover 6 along this opposite side (arrow G in FIG. 4), until the third fastening means (for example an eyelet) of the cover are facing the third fastening means (for example a T-shaped finger) located at a third location $P_3$ of the pool. He assembles these fastening means such that the cover 6 is then unrolled and fastened over most of the pool.

Figure 5:
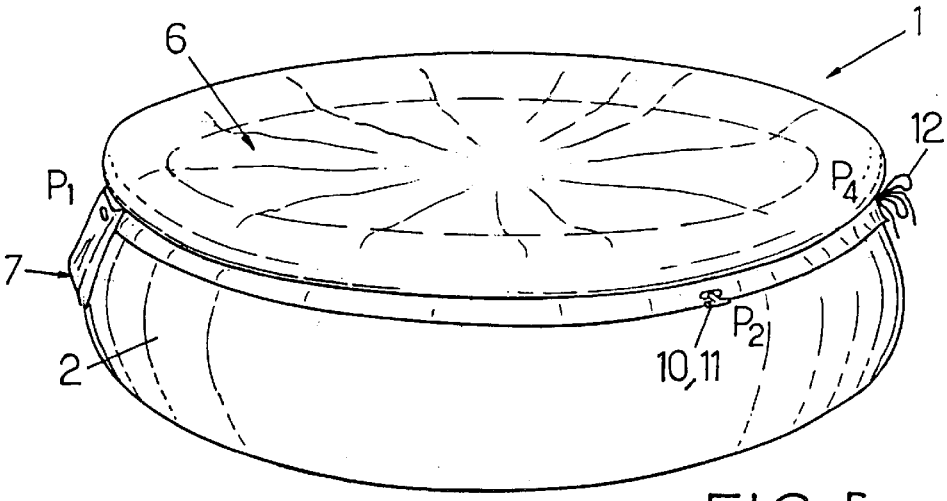

Finally, the user positions himself approximately on the side opposite said first location and grasps the free end of the cover which he pulls toward him in order to completely cover the pool as shown in FIG. 5 (in this FIG. 5, the pool is shown from a different angle so that it is possible for said first location $P_1$ and the opposite location or fourth location $P_4$ to be seen simultaneously).

The cover 6 is provided with peripheral lacing means, in particular continuous means, as illustrated (but which could be discontinuous), consisting of a cord 12 which is engaged peripherally under the inflatable chamber 3. Being located at said fourth location $P_4$, the user tightens the lacing means using tensioning means: put simply, the two branches of the cord 12 are tightened and its free ends are tied, as shown in FIG. 5, such that the cover 6 is then firmly fastened under the chamber 3 over its entire periphery and can no longer be lifted even in the case of a gust of wind.

Figure 6:
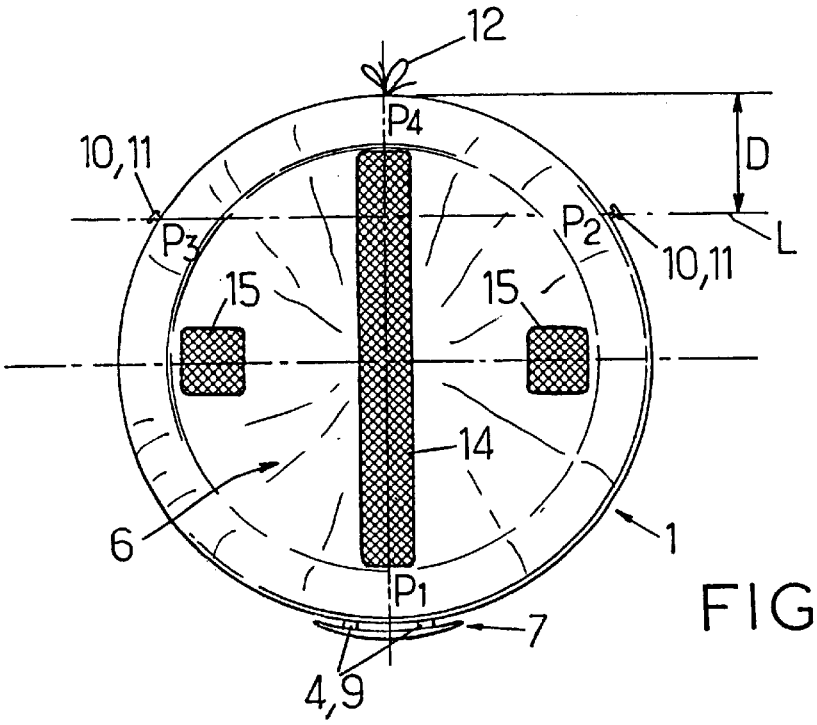
FIGS. 6 and 7 are top views respectively illustrating two pools of different shapes, covered according to the invention with respective covers constituting preferred variants of the cover illustrated in FIG. 5.

The pool 1 equipped with its cover 6 is shown, schematically in top view, in FIG. 6, and the first, second, third and fourth locations $P_1$ to $P_4$, respectively, mentioned above, can be better identified therein.

The second and third locations $P_2$ and $P_3$ must be located such that the user located at the fourth location $P_4$ is able to grasp the free end of the cover previously attached to the locations $P_2$ and $P_3$. In other words, since the locations $P_2$ and $P_3$ define a line L, the distance D from the fourth location $P_4$ to the line L should be at most equal to an arm's length, that is to say of the order of about 1 m.

By virtue of the arrangements of the invention, it is possible for a single user to put a cover in place over a pool in spite of the latter having a not very favorable structural shape, and it can be put in place with a limited number of manipulations (four in the example which has just been described).

Of course, additional fastening locations can be provided if that proves to be necessary or desirable, especially for large pools, it being however emphasized that the fastening locations are mainly provided to facilitate putting the cover on, although the cover is secured to the pool by the lacing means engaged under the projecting edge of the pool.

Figure 7:
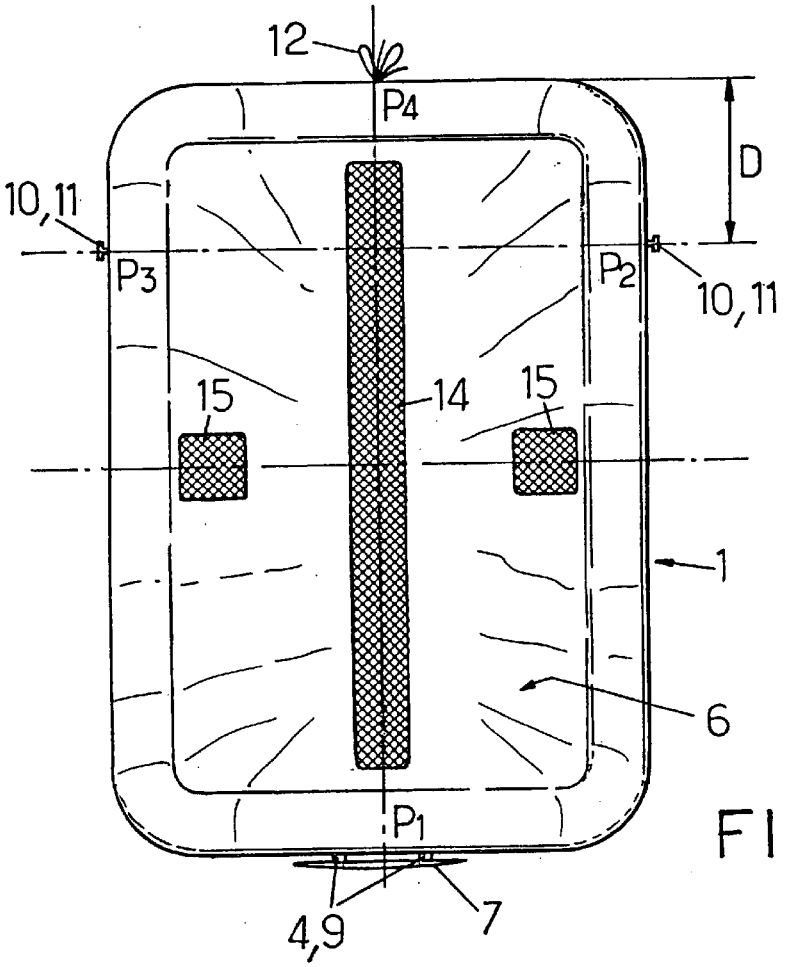

As indicated above, the provisions of the invention find a preferred application for pools of continually concave curved general shape and especially round pools. However, the invention may also be used for pools of different shapes. By way of example, FIG. 7 illustrates the implementation of the invention for a rectangular pool, said first location $P_1$ then advantageously being provided roughly in the middle of a short side and the second and third locations being located respectively on the two large sides near to the opposite short side.

Furthermore, the arrangements of the invention may be applied to above-ground pools with a structure different from that of a self-supporting above-ground pool. In particular, they could be applied to pools with a flexible "liner" wall supported by a rigid external frame provided that this pool has a peripheral upper rim which projects outward so that the lacing means can be engaged under this projecting rim.

Provision may advantageously be made, especially for the cover, for various arrangements to simplify its use.

With regard first of all to the bag 7, it is noticed that, in the position for putting the cover 6 over the pool (FIGS. 4 and 5), the bag 7 hangs over the side of the pool. To prevent it hanging so that it gapes, thereby being filled with water should it rain for example, closure means (push buttons 13, adhesive tape or hooks, etc.) are provided in order to keep it closed.

Moreover, in a manner known per se, it is desirable that rainwater does not stagnate on the tightened cover so that the latter is not weighed down with the risk of causing the fastening/lacing means to come off and also to facilitate its taking off. For this purpose, provision is made for the cover 6 to have a region 14, which is permeable to liquids, in the form of a strip lying approximately in a direction joining the first and fourth locations $P_1$, $P_4$, as illustrated in FIGS. 6 and 7, and extending over most of the distance separating said locations $P_1$, $P_4$.

Moreover, still for the purposes of facilitating the removal of water when taking the cover 6 off, it is possible to provide two regions 15, which are permeable to liquids, which are located one on either side of said region 13 in the form of an elongated strip and over a transversal to the latter approximately in its middle and toward the periphery of the cover: especially in the diameter perpendicular to the diameter $P_1$, $P_4$ if the pool is round (FIG. 6) or on the midline of the long sides if the pool is rectangular (FIG. 7).

What is claimed is:

1. An above-ground pool which can be covered using a removable cover, the pool and the cover being fitted with mutual fastening means distributed over their respective perimeters, wherein:

the pool has an upper edge protruding radially outward from the immediately underlying sidewall, first fastening means are provided on the cover folded in an arrangement for storage and in a first location on the perimeter of the pool, under said peripheral edge projecting therefrom, to allow the initial attachment of the cover to the pool, second and third fastening means are provided in a second and a third location respectively, on the perimeter of the cover and on the perimeter of the pool, under the peripheral edge projecting therefrom, for the intermediate attachment of the cover, these second and third locations being located on either side of the mid-plane of the pool passing through said first location and being located such that a line joining them is located at arm's length from a fourth location of the pool opposite said first location, and lacing means are secured to the peripheral edge of the cover with tensioning means located at said fourth location on the perimeter of the cover located approximately on the opposite side from said first fastening location and corresponding with said fourth location of the pool, said tensioning means being suitable for tightening the lacing means engaged under the peripheral edge projecting from the pool, whereby the cover can be easily and quickly fitted to the pool by a single person, with a minimum number of manipulations.

2. Pool according to claim 1, wherein said second and third fastening locations are located approximately symmetrically on either side of a line joining said first and fourth locations on the perimeter of the pool and of the cover.

3. Pool according to claim 1, wherein said cover is secured to a bag suitable for containing it folded in a storage arrangement, and wherein the first fastening means are secured to said bag.

4. Pool according to claim 3, wherein said bag has at least one perforated region, located toward its bottom, for the water to flow out.

5. Pool according to claim 3, wherein said bag comprises closure means suitable for keeping it closed while the cover is unfolded over the pool.

6. Pool according to claim 3, wherein said fastening means comprise, on the one hand, T-shaped fingers fastened to the pool, the cover or the bag, respectively and, on the other hand, eyelets suitable for accommodating said T-shaped fingers and provided on the cover, the bag or on the pool, respectively, wherein said first fastening means comprise at least one T-shaped finger provided on the storage bag at the first location of the folded cover and at least one corresponding eyelet provided at the first location on the perimeter of the pool, and wherein said second and third fastening means comprise eyelets provided at the second and third locations of the respective cover and T-shaped fingers provided at the second and third locations of the perimeter of the pool.

7. Pool according to claim 1, wherein said fastening means comprise, on the one hand, T-shaped fingers fastened to the pool, the cover or the bag, respectively and, on the other hand, eyelets suitable for accommodating said T-shaped fingers and provided on the cover, the bag or on the pool, respectively.

8. Pool according to claim 1, wherein it is defined peripherally by at least one inflatable flexible chamber, and wherein the means for fastening and the means for lacing the unfolded cover are located under this chamber.

9. Pool according to claim 1, wherein said cover has a region, which is permeable to liquids, in the form of a strip lying approximately in a direction joining the first and fourth fastening locations and extending over most of the distance separating said locations, for the purposes of allowing water deposited on the top of the cover used over the pool to pass through.

10. Pool according to claim 9, wherein said cover further comprises two regions, which are permeable to liquids, which are located on either side of said region in the form of an elongated strip and over a transversal to the latter approximately in its middle and toward the periphery of the cover.

11. Pool according to claim 1, wherein it has a periphery of continually concave curved general shape, in particular approximately round.

* * * * *